US007530254B2

(12) United States Patent
Bilstein et al.

(10) Patent No.: US 7,530,254 B2
(45) Date of Patent: May 12, 2009

(54) BENDING DEVICE FOR BENDING IN A LOCKING PLATE OF A ROTOR OF A TURBINE

(75) Inventors: Björn Bilstein, Essen (DE); Peter Schröder, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/008,008

(22) Filed: Jan. 8, 2008

(65) Prior Publication Data

US 2008/0163665 A1 Jul. 10, 2008

(30) Foreign Application Priority Data

Jan. 9, 2007 (EP) ..... 07000380

(51) Int. Cl.
*B21D 7/02* (2006.01)
*F01D 5/32* (2006.01)

(52) U.S. Cl. ..... 72/458; 72/388; 72/479; 416/212 R; 416/220 R

(58) Field of Classification Search ..... 72/388, 72/479, 457, 458; 416/212 R, 220 R, 221
See application file for complete search history.

(56) References Cited

U.S. PATENT DOCUMENTS 3,045,329 A * 7/1962 Carli et al. ..... 416/221
3,248,921 A * 5/1966 Trout ..... 72/458
3,598,503 A * 8/1971 Muller ..... 416/221
4,102,602 A * 7/1978 Rottenkolber ..... 416/221
4,672,836 A * 6/1987 Wilkinson et al. ..... 72/479
4,846,628 A 7/1989 Antonellis
5,425,621 A * 6/1995 Maar ..... 416/221
5,901,600 A * 5/1999 Decker ..... 72/388
6,023,959 A * 2/2000 Stratton ..... 72/458
6,109,877 A * 8/2000 Gekht et al. ..... 416/221
6,416,282 B1 * 7/2002 Beeck et al. ..... 416/97 R
6,837,686 B2 * 1/2005 Di Paola et al. ..... 416/220 R
7,229,252 B2 * 6/2007 Hermiston et al. ..... 416/220 R
7,264,448 B2 * 9/2007 Garner ..... 416/212 R

FOREIGN PATENT DOCUMENTS

DE 1 963 364 A1 7/1970
JP 2000008808 A 1/2000

* cited by examiner

*Primary Examiner*—David B Jones

(57) ABSTRACT

The invention relates to a bending device for bending in a locking plate of a rotor of a turbine, by means of which a reliable fastening of the locking plate is carried out. The bending device comprises a mounting which has two sections, the first section of which is inserted into the groove of the rotor, and the second section of which, with the mounting inserted in the groove, projects from this groove. By means of a lever, which is rotatably mounted on the second section, the locking plate can be reliably bent over for securing a bolt against loss.

8 Claims, 3 Drawing Sheets

BENDING DEVICE FOR BENDING IN A LOCKING PLATE OF A ROTOR OF A TURBINE

CROSS REFERENCE TO RELATED APPLICATIONS

This application claims the benefits of European application No. 07000380.1 filed Jan. 9, 2007, both of the applications are incorporated by reference herein in their entirety.

FIELD OF INVENTION

The invention relates to a bending device for bending in a locking plate of a rotor of a turbine, which locking plate is inserted in a groove which extends along the circumference of the rotor.

BACKGROUND OF THE INVENTION

It is known to secure the seal elements, which are arranged on one end face of the rotor, against a displacement in the circumferential direction by means of locking plates. In this case, the seal elements are first inserted into circumferential grooves on the rotor disk, after which a locking plate, which is arranged on the seal element, is bent in a recess which is provided on the rotor. The bending process is manually carried out by means of a simple lever which is seated in a gullet of the rotor disk and supported upon this during the bending process.

A disadvantage of the known installation arrangement is that the lever which is used for bending the locking plate can possibly slip off sideways from the rotor disk.

SUMMARY OF INVENTION

The object of the invention, therefore, is the provision of a bending device for bending a locking plate, by which a secure and always reproducible effect for the locking plates which are to be bent over can be achieved.

The object which is focused upon the device is achieved by a bending device according to the features of the claims.

The bending device according to the invention comprises a mounting, which has two sections, the first section of which can be inserted into the groove of the rotor, and the second section of which, with the mounting inserted in the groove, projects from this, and also a lever, which is rotatably mounted on the second section, with a contact surface for bearing upon a leg, which is to be bent over, of the locking plate which is inserted in the groove.

According to the invention, the bending over of a locking plate, which is inserted in the circumferential groove of a rotor, can be especially simply and reliably carried out if a bending device is used which is secured in its position during the bending operation. This is achieved by inserting a bending device in that groove in which the locking plate has also been installed.

The locking plate, which is rectangular before the bending over, projects by one of its two legs from the groove of the rotor. The contact surface which is provided on the lever serves for bearing upon that leg of the locking plate which projects from the groove of the rotor. By means of the manual operation of the lever, this leg is partially bent over a protrusion so that this leg bears upon the protrusion on both sides.

Further advantageous developments are disclosed in the claims.

The lever is expediently pivotable around a rotational axis which, with the bending device located in the operating position, is perpendicular to the radial direction of the rotor. As a result the leg of the locking plate bent over in a manner according to design.

The first section of the mounting can be expediently laid along the extent of the groove base of the groove. Tilting of the bending device is prevented by the flat contact of the first section on the groove base of the groove. This ensures that the rotational axis of the lever is always oriented perpendicularly to the radial direction of the rotor.

In order to achieve a correct orientation of the bending device in relation to the rotor, the first section of the mounting is provided with a recess. The recess is preferably arranged in the middle on the first section, as seen in the circumferential direction. The recess is provided to accommodate either the bolt (which retains the locking plate, and which extends through the locking plate), or that leg of the locking plate which is inserted in the groove. In the first embodiment, the first section of the mounting has a wall thickness which corresponds to the width of the groove, reduced by the wall thickness of the locking plate. In a second embodiment, the first section has a wall thickness which corresponds to the width of the groove. With both embodiments, the bending device, as seen in the circumferential direction of the rotor, can be accurately orientated in relation to the latter, so that for bending the leg over, the bending device is always arranged in a chosen operating position. The bending device is then seated in the groove.

The second section of the mounting expediently has a wall thickness which is greater than the width of the groove.

BRIEF DESCRIPTION OF THE DRAWINGS

The invention is explained in detail based on a drawing, wherein further features and advantages are described.

In the drawing.

DETAILED DESCRIPTION OF INVENTION

Figure 1:
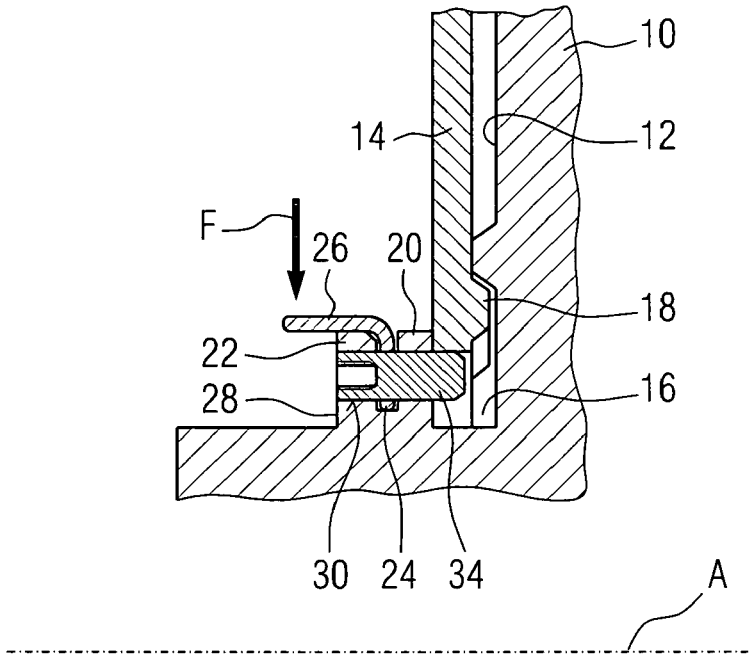
FIG. 1 shows a view in cross section taken through the outer end of a rotor disk with a seal element arranged on the end face.

In FIG. 1, a cross section through the outer region of a rotor disk 10 of a turbine is shown. An axial direction of the rotor, which coincides with its rotational axis, is indicated by A. Retaining grooves, which extend in the axial direction and are uniformly distributed along the circumference, are provided on the outer generated surface of the rotor disk 10, in which rotor blades of the turbine can be inserted. In order to secure the rotor blades, which are inserted in the retaining grooves, against a displacement in the axial direction, a so-called seal element 14 is provided on at least one end face 12 of the rotor disk 10 and in each case overlaps the end face opening of one of the retaining grooves. The inner end 18 of the seal element 14 is inserted y into a seal groove 16 which extends circumferentially about the rotor axis A. The encompassing seal groove 16 is delimited by the end face 12 of the rotor disk 10 on the one hand, and on the other hand by a similarly endlessly encompassing first projection 20 which is adjacent to the rotor disk. An additional endlessly encompassing projection 22 is provided adjacent to the first projection 20, wherein an additional groove 24 is included between the first projection 20 and the additional projection 22. The additional groove 24 is provided for accommodating a locking plate 26. Openings in the form of holes 30 are provided on one side face 28 of the additional projection 22, which holes are distributed along the circumference and extend through the side walls of the additional groove 24 and of the seal groove 16. Each hole 30 is provided for accommodating a bolt 34 which keeps the seal element 14, which is seated in the seal groove 16, in its operating position and secures the seal element against a displacement in the circumferential direction, i.e. perpendicularly to the plane of the drawing.

Figure 2:
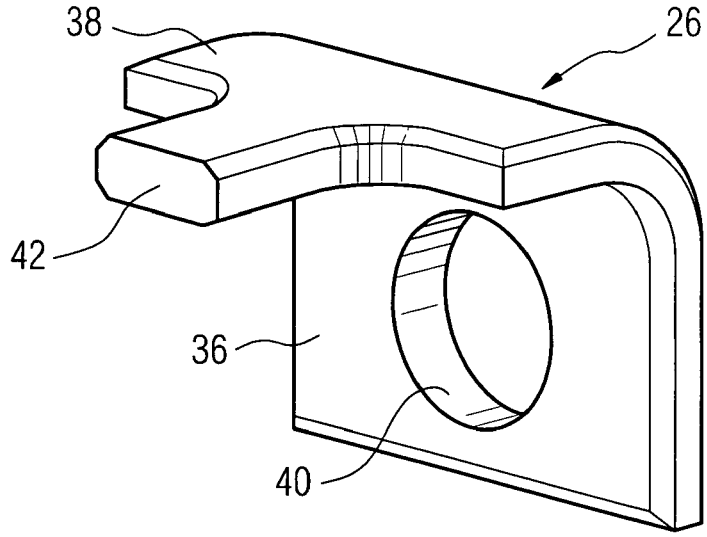
FIG. 2 shows the locking plate in a perspective view.

In FIG. 2, an embodiment of the locking plate 26 is shown, with a first leg 36 and a second leg 38. The two legs 36, 38 of the locking plate 26 are approximately perpendicular to each other before its use. The first leg 36 in this case is formed flat and has a central hole 40 in which the bolt 34 is to be inserted. The second leg 38, on the other hand, is formed partially narrower than the first leg 36 so that this leg ends with a tongue 42. The tongue 42 is provided for at least partially overlapping the end face opening of the hole 30 in the installed state.

Figure 3:
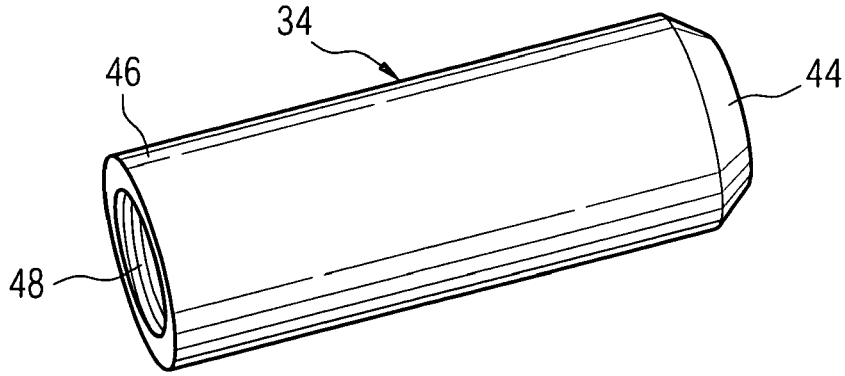
FIG. 3 shows a bolt.

In FIG. 3, the bolt 34, which is to be inserted in the arrangement according to FIG. 1, is shown in perspective view. The bolt 34 in this case has a first end 44, which is provided with a chamfer, and also a second end 46 in which a hole 48, which is equipped with a thread, is provided on the end face.

For assembling the arrangement which is shown according to FIG. 1, rotor blades, which are not shown, are inserted in retaining grooves, which are not shown. The seal element 14 is then inserted into the seal groove 16 by means of a combined radial and axial movement and then tilted towards the end face 12 of the rotor disk 10 until this seal element is orientated approximately parallel to the end face 12. After that, the locking plate 26 is inserted into the additional groove 24 so that its hole 40 aligns with the hole 30. Subsequently, the bolt 34 is inserted into the hole 30, wherein this engages in a recess of the seal element 14. In order to secure the bolt 34 against loss, one of the legs of the locking plate 26 is to be bent over by applying a force F in such a way that its free leg 36 at least partially overlaps the end face opening of the hole 30 accordingly.

Figure 4:
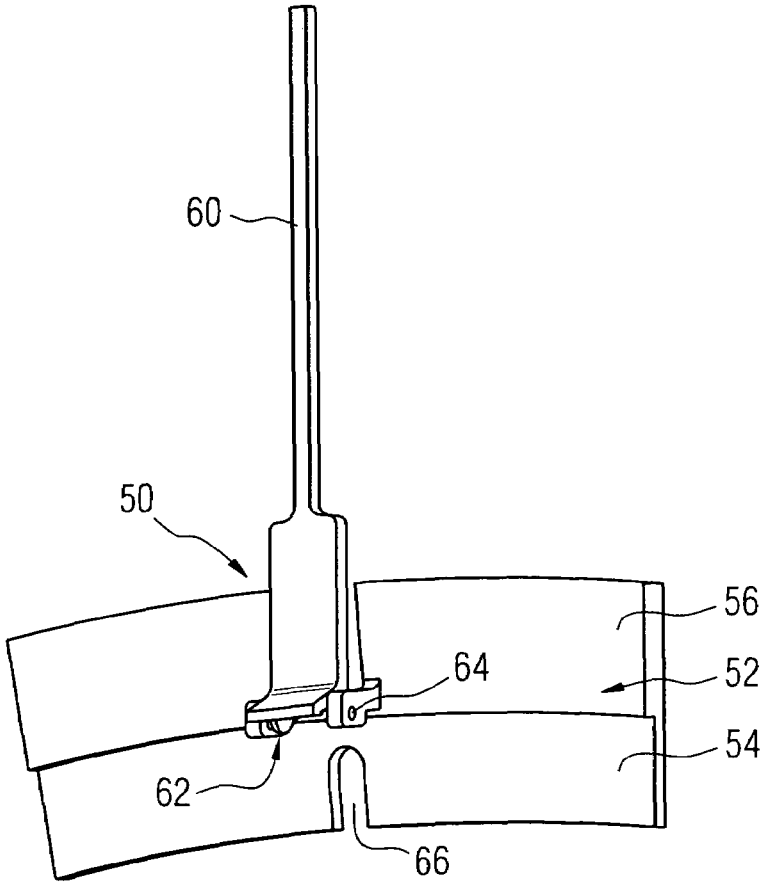
FIG. 4 shows the bending device according to the invention, in perspective view.

In FIG. 4, the bending device 50, which is provided for bending in the locking plate 26, is perspectively shown. The bending device 50 in this case comprises a mounting 52 which consists of a first section 54 and a second section 56. The first section 54 is provided for inserting into the additional groove 24 of the rotor. The second section 56, which is adjacent to the first section 56 radially on the outside, has a lever 60 with a contact surface 62 for bearing upon the leg, which is to be bent over, of the locking plate 26 which is inserted in the additional groove 24. The lever 60 in this case is pivotable around a rotational axis 64 which, with the bending device 50 inserted in the groove 24, is perpendicular to the radial direction of the rotor.

The first section 54 of the mounting 52 is provided with a recess 66. In a first embodiment, the recess 66 is provided for the first section 54 being able to be additionally inserted into the additional groove, despite the bolt 34 being inserted in the additional groove 24 and despite the locking plate 26 being inserted. For this, it is necessary that the recess 66, as seen in the circumferential direction of the rotor, has a width which corresponds at least to the diameter of the bolt 34. In this embodiment, the first section 54 of the mounting 52 has a wall thickness which corresponds to the width of the additional groove 24, reduced by the wall thickness of the locking plate 26.

In an alternative development of the bending device 50, the recess 66 has a width which corresponds at least to the width of the locking plate 26, as seen in the circumferential direction. For this alternative development, which is not shown, it is provided that both the first leg 36 of the locking plate 26 and the first section 54 has a wall thickness in each case which is identical to the width of the additional groove 24.

For each of the two aforementioned embodiments, it can be ensured that the locking plate 26 is retained approximately free of clearance in the additional groove 24 during the bending process. The locking plate 26 is then in the braced position so that by operating the lever 60 the freely ending tongue 42 can be bent onto the side face 28 of the additional projection 22 in order to at least partially overlap the opening of the hole 30.

Figure 5:
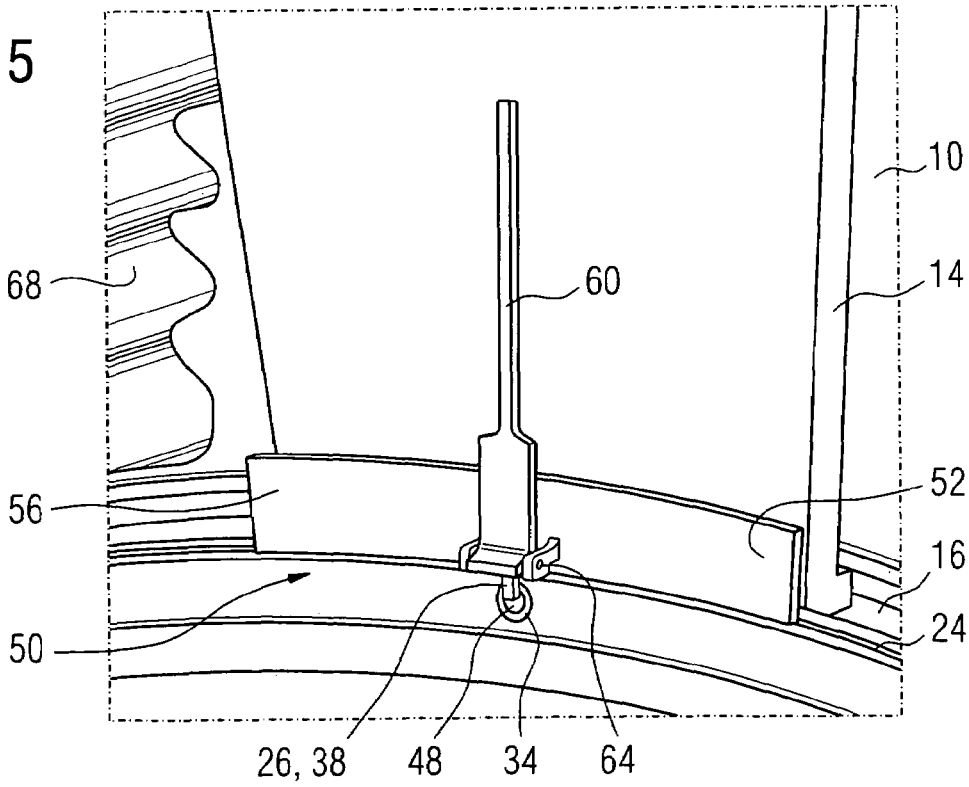
FIG. 5 shows a bending device in a groove which extends along the circumference of the rotor, in perspective view.

FIG. 5 shows in perspective view, the bending device 50 in its operating position. In this case, the bending device 50 is partially inserted by its mounting 52 into the additional groove 24. In this case, the first section 54, which lies radially on the inside in the operating position, is especially completely inserted in the groove 24. Furthermore, FIG. 5 shows the seal element 14 inserted in the seal groove 16, and also a retaining groove 68 for rotor blades, which is provided on the outer circumference of the rotor disk 10. The locking plate 26 in the illustration which is shown is already bent over so that the second leg 38 of the locking plate 26 already partially closes off the opening of the hole 30 and secures the bolt 34 against loss.

Figure 6:
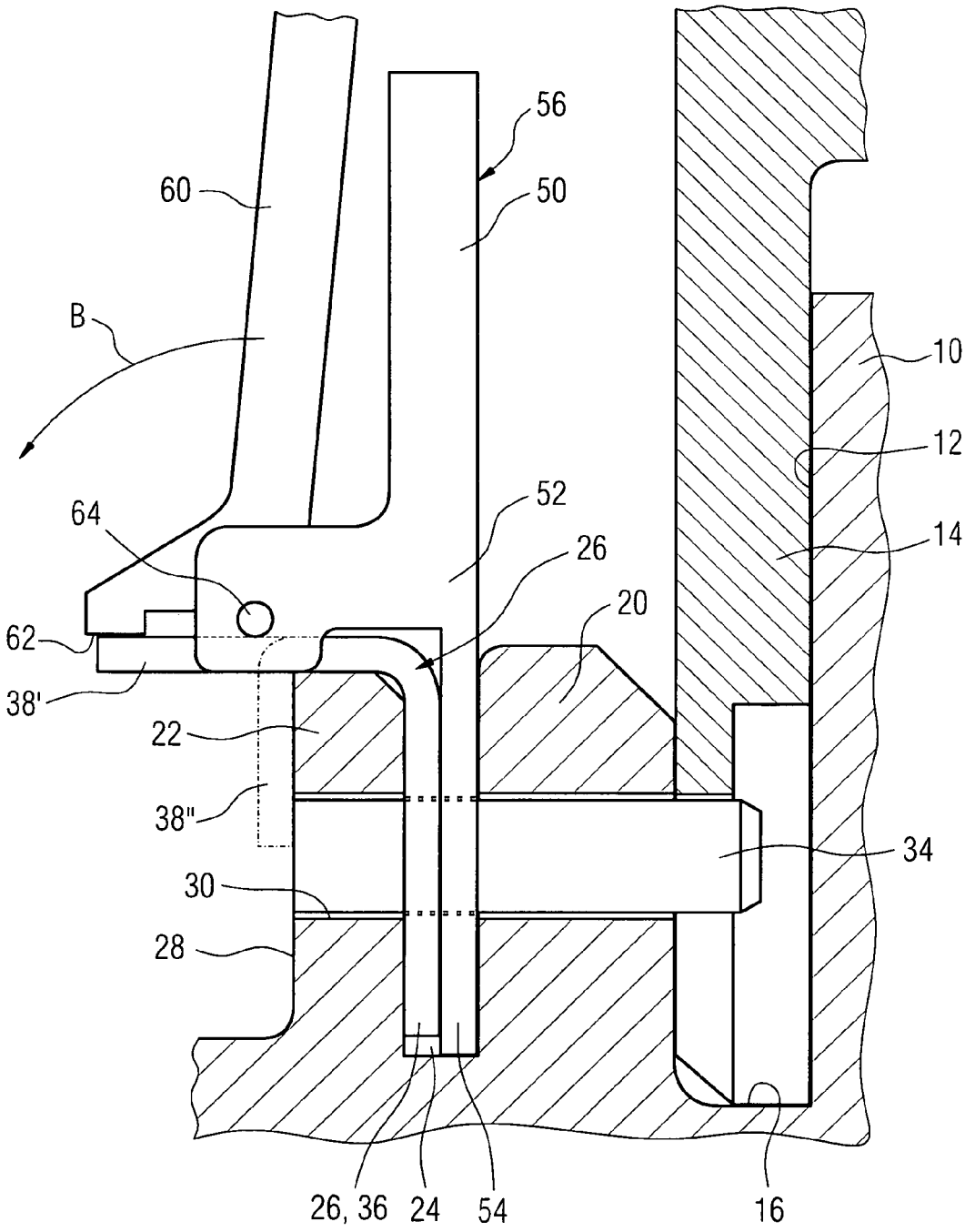
FIG. 6 shows a cross section through the arrangement according to FIG. 5.

FIG. 6 shows a cross section through the arrangement according to FIG. 5, with seal element 14 arranged in the seal groove 16, with locking plate 26 arranged in the additional groove 24, and with bending device 50 inserted in the groove 24. The bending device 50, the groove 24 and the locking plate 26, and also the projection 22, in this case are matched to each other so that if the first section 54 of the mounting 50 is seated flat along the groove base of the groove 24, the contact surface 62 of the lever 60 can bear upon the leg 38' which is still to be bent over. By the pivoting of the lever 60 around the rotational axis 64 according to the arrow B, the leg 38' can be bent over into the second position, which is represented by 38". In this position, the second leg 38" closes off the hole 30.

By the predetermined development of the bending device, each locking plate can be fastened on the rotor disk in a predetermined manner, as a result of which an especially reliable and secure installation can be ensured.

According to the invention a bending device 50 for bending in a locking plate 26 of a rotor of a turbine has been disclosed which provides for reliable fastening of the locking plate 26. The bending device comprises a mounting 52, which has two sections 54, 56, the first section 54 of which is inserted into the groove 24 of the rotor, and the second section 56 of which, with the mounting 52 inserted in the groove 24, projects from this groove. By means of a lever 60, which is rotatably mounted on the second section 56, the locking plate 26 can be reliably bent over for securing a bolt 34 against loss.

The invention claimed is:

1. A bending device for bending a locking plate, positionable in a groove of a rotor of a turbine, that is to be bent over, the groove extending along a circumference of the rotor, comprising:

a mounting having first and second sections adjacent to each other, the first section insertable into the groove of the rotor, and the second section, projecting from the groove when the mounting is inserted in the groove, and a lever that is rotatably mounted on the second section of said mounting with a contact surface for bearing upon a leg of the locking plate that is to bent over after the locking plate is inserted in the groove.

2. The bending device as claimed in claim 1, wherein the lever is pivotable around a rotational axis and, is perpendicular to the radial direction of the rotor when the first section is inserted in the groove.

3. The bending device as claimed in claim 2, the when the bending device is in the operating position, the first section lays along the extent of the groove base of the groove.

4. The bending device as claimed in claim 3, wherein the first section of the mounting is provided with a recess.

5. The bending device as claimed in claim 4, wherein the recess is positioned in the middle on the first section as seen in the circumferential direction.

6. The bending device as claimed in claim 5, wherein the first section has a wall thickness which corresponds to the width of the groove, reduced by the wall thickness of the locking plate, and the recess has a width in the circumferential direction which corresponds at least to the diameter of the bolt.

7. The bending device as claimed in claim 6, wherein the second section has a wall thickness greater than the width of the groove.

8. The bending device as claimed in claim 5, wherein the first section has a wall thickness which corresponds to the width of the groove, and the recess has a width which corresponds to the width of the locking plate.

* * * * *